US005257874A

United States Patent [19]

Kato et al.

[11] Patent Number: 5,257,874

[45] Date of Patent: Nov. 2, 1993

[54] POLE DEVICE FOR SKIING CONTEST

[75] Inventors: Koji Kato; Kiyoshi Shimura, both of Tokyo, Japan

[73] Assignee: K & K Kogyo Kabushiki Kaisha, Tokyo, Japan

[21] Appl. No.: 22,278

[22] Filed: Feb. 25, 1993

[30] Foreign Application Priority Data

Feb. 28, 1992 [JP] Japan ..... 4-78870

[51] Int. Cl.[5] ..... E01F 9/00

[52] U.S. Cl. ..... 404/9; 256/19; 403/348

[58] Field of Search ..... 404/9-11; 52/155, 157, 165; 256/19; 403/348, 349

[56] References Cited

U.S. PATENT DOCUMENTS

| | | | |
|---|---|---|---|
| 513,115 | 1/1894 | Kiler | 52/165 |
| 2,820,655 | 1/1958 | Hileman | 403/349 |
| 3,664,444 | 5/1972 | Henson | 403/349 X |
| 4,871,279 | 10/1989 | Hinterholzer | 404/10 |
| 5,054,955 | 10/1991 | Habernig | 404/10 |

*Primary Examiner*—Ramon S. Britts
*Assistant Examiner*—James A. Lisehora
*Attorney, Agent, or Firm*—Sughrue, Mion, Zinn, Macpeak and Seas

[57] ABSTRACT

A pole device for a skiing contest comprises a cylindrical member to be embedded in a snow ground, a pole base member to be fitted into the cylindrical member and a pole portion fitted into the pole base member. The pole base member is formed with grooves extending in an axial direction thereof on an outer peripheral surface thereof and the cylindrical member is formed with projections at an inner peripheral surface thereof. Each of the projections has an outer shape to be fitted in the groove. The groove is composed of a first guide groove having an end portion through which the projection enters the groove, a second guide groove formed to be continuous to the first guide groove through a circumferintially shifted groove portion and a circumferential fitting groove formed at a portion near upper end of the pole base member to be continuous to the second guide groove. A pair of grooves are formed on the outer peripheral surface of the pole base member in an axial symmetrical arrangement and a pair of projections are formed on the inner peripheral surface of the cylindrical member in an axial symmetrical arrangement. A triangular guide piece is formed to an edge portion of each of the circumferentially shifted groove portions so as to project inward thereof.

9 Claims, 2 Drawing Sheets

POLE DEVICE FOR SKIING CONTEST

BACKGROUND OF THE INVENTION

The present invention relates to a pole device used for example as a flag gate for a skiing contest such as an uphill turn and the like.

Well known is a pole device for the skiing contest having a cylindrical portion to be embedded in snow on the ground and a base portion of a pole member to be fitted into the cylindrical portion to thereby stand up the pole member on the snow surface.

In use of the pole device of the known type, there is a case that the pole member is broken or snapped during the skiing contests, and for this reason, it is desired to easily drawn out the pole member from the cylindrical portion embedded in the snow for easily and quickly exchanging the broken pole member with new one. On the contrary, it is also desired that the pole member is not easily drawn out without manual operation because the easy draw-out of the pole member during the skiing contest is dangerous for players and the exchanging working is also troublesome.

As described above, it is desired for the pole device to have functions which are mutually conflicted from each other, and in order to satisfy these conflicting functions, in the prior art, there is provided a pole device having a cylindrical portion formed with a female threaded portion on the inner peripheral surface thereof and having a pole base portion formed with a male threaded portion on the outer peripheral surface to be engaged with the female threaded portion.

However, in this pole device, such problem is proposed as that the pole base portion is rotated and finally drawn out from the cylindrical portion by repeated colliding of contestants or players with the pole device. Namely, in the conventional structure of the pole device, there is a fear that the pole portion is drawn out from the cylindrical portion embedded in the snow unintentionally with no manual operation.

SUMMARY OF THE INVENTION

An object of the present invention is substantially eliminate defects or drawbacks encountered in the prior art described above and to provide a pole device in which a pole portion including a pole base portion is hardly drawn out from a cylindrical portion embedded in a snow ground unintentianally during the skiing contest and is capable of being easily drawn out in a case where the pole base portion is intended to be manually drawn out from the cylindrical portion.

This and other objects can be achieved according to the present invention by providing a pole device for a skiing contest, the pole device comprising a cylindrical member to be embedded in a snow ground, the cylindrical member having inner hollow portion, a pole base member to be fitted into the inner hollow portion of the cylindrical member, and a pole portion fitted into the pole base member and standing upward on the snow ground when the pole base member is fitted to the cylindrical member embedded in the snow ground, wherein the pole base member is formed with a groove means extending in an axial direction thereof on an outer peripheral surface thereof and the cylindrical member is formed with a projection means at an inner peripheral surface of an open end of the inner hollow portion, the projection means having an outer shape to be fitted in the groove means of the pole base member at one end thereof, the groove means being composed of a first guide groove having an end portion through which the projection means enters the groove means, a second guide groove formed to be continuous to the first guide groove and a circumferential groove formed at a portion near another end of the pole base member to be continuous to the second guide groove, the first guide groove being provided with a circumferentailly shifted groove portion of the pole base member and the second guide groove being continuous to the circumferentially shifted groove portion.

In a preferred embodiment, a pair of groove means are formed on the outer peripheral surface of the pole base member in a symmetrical arrangement with respect to an axis thereof and a pair of projection means are formed on the inner peripheral surface of the cylindrical member in a symmetrical arrangement with respect to an axis thereof, the projection means being positioned at portions corresponding to the arrangment of the groove means when fitted.

A triangular guide piece is formed to an edge portion of each of the circumferentially shifted groove portions so as to project inward thereof. Each of the projection means has a width smaller than each of widths of the first and second guide grooves and has an axial length smaller than each of axial lengths of the circumferentially shifted groove portion on both axial sides of the guide piece.

The circumferential groove is provided with projections extending inward thereof from upper and lower edge portions, the projections having a distance therebetween slightly larger than an axial length of the projection means, the pole base member being positioned between the projections when the pole base member is finally fitted in the cylindrical member embedded in the snow ground.

The cylindrical member is formed with a spiral projection on an outer peripheral surface of the cylindrical member and the spiral projection has cutout portions at which projection pieces are formed.

According to the structure of the present invention, the pole base member is easily fitted to the cylindrical member by abutting the projections of the cylindrical member against the first guide grooves of the pole base member and then depressing downward the pole base member. Upon the depression, the projections enter the grooves and axially advance therein along the shapes of the grooves. However, when the pole base member is drawn out from the cylindrical member manually by hands, lifting operation, circumferentially rotating operation and other operations are required for the base member. Namely, the pole base member is first slightly lifted upward and rotated in one circumferential direction though these operations are easily performed. The pole base member is then rotated in reverse circumferential direction and finally lifted upward. These manual operations are required when the pole base member is drawn out manually from the cylindrical member.

The nature and further features of the present invention will be made more clear hereunder through description with reference to the accompanying drawings.

DESCRIPTION OF THE PREFERRED EMBODIMENT

Figure 1:
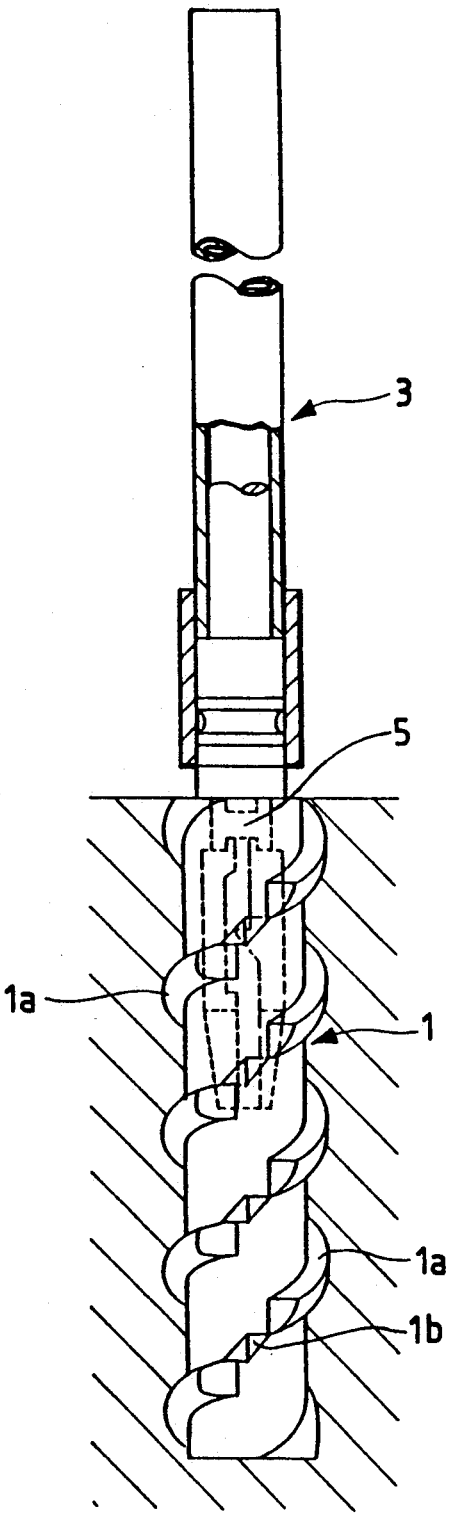
FIG. 1 is a front view, partially in section, of one embodiment of a pole device for skiing contest according to the present invention.

A pole device adapted for skiing contests according to the present invention comprises, as shown in FIG. 1, a cylindrical member 1 which is to be embedded in snow ground and a pole base member 5 into which a pole 3 is fitted.

Referring to FIG. 1, the cylindrical member 1 is formed with a spiral projection 1*a* on its outer peripheral surface, and this spiral projection 1*a* acts as a screw when the cylindrical member 1 is forcibly embedded in the snow and also attains a draw-out preventing function after the cylindrical member 1 has been once embedded in the snow. In order to facilitate these functions, in the illustration, the spiral projection 1*a* has cutout portions and a plurality of projected pieces 1*b* each having a shape different from the spiral form of the projection 1*a* are formed on the cutout portions of the spiral projection 1*a*, but the formation of such projected pieces 1*b* is optional. The cylindrical member 1 has an inner hollow portion in which the pole base member 5 is fitted. In this condition, the pole 3 is fitted into the inner hollow portion of the pole base member 5 through a known spring means so that the pole 3 stands upward from the pole base member 5 through the spring means. Of course, the pole 3 may be preliminarily fitted into the pole base member 5 before the fitting into the cylindrical member 1. According to the location of the spring means, the pole 3 is flexibly bent bilaterally when a contentant collides with the pole 3 during the skiing contest.

According to the structure of the pole device of the present invention, the pole base member 5 can be easily fitted into and drawn out from the inner hollow portion of the cylindrical member 1 when an operator intends to fit the pole base member 5 into the cylindrical member 1 or to draw out the same therefrom, but the pole base member 5 cannot easily be drawn out from the cylindrical member 1 when the pole base member 5 is unintentionally drawn out from the cylindrical member 1.

Figure 2:
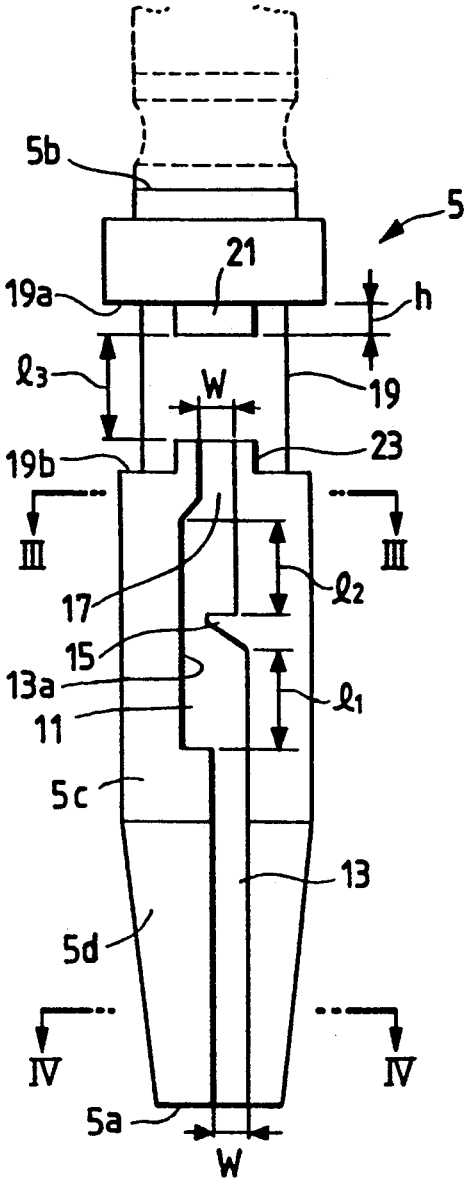
FIG. 2 is a front view of a pole base member of the pole device of FIG. 1.
Figure 3:
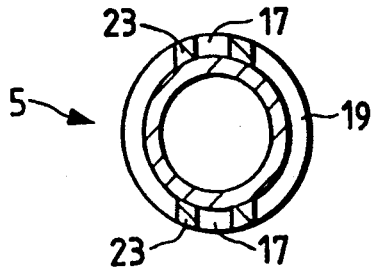
FIG. 3 is a sectional view taken along the line III—III of FIG. 2.
Figure 4:
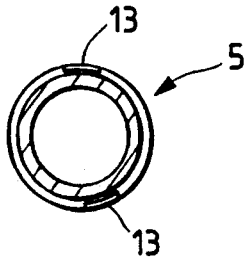
FIG. 4 is a sectional view taken along the line IV—IV of FIG. 2.

Namely, as shown in FIGS. 2 to 4, the pole base member 5 has lower and upper ends 5*a* and 5*b* and is composed of substantially a cylindrical portion 5*c* and a frustoconical front end portion 5*d*. Of course, the pole base member 5 may be formed to have cylindrical shape entirely in the axial direction without forming the frustoconical end portion. A groove 11 is formed to an outer peripheral surface of the pole base member 5. The groove 11 is opened at the lower end 5*a* of the front end portion 5*d* and is composed of first and second guide grooves 13 and 17. The first guide groove 13 extends upward in an axial direction of the pole base member 5 from the lower end 5*a* of the pole base member 5 and the first guide groove 13 is formed with a circumferentially shifted groove portion 13*a* formed to the cylindrical portion 5*c* of the pole base member 5. The second guide groove 17 is formed to be continuous to the shifted groove portion 13*a* and extends upwards in the axial direction of the pole base member 5. A guide piece 15 having substantially a triangular shape is formed to the pole base member 5 so as to project at an edge portion of the circumferentially shifted groove portion 13*a* between the first and second guide grooves 13 and 17. That is, the guide piece 15 projects inward of the circumferentially shifted groove portion 13*a*. As shown in FIG. 2, the triangular guide piece 15 has a upward tapered lower portion.

The second guide groove 17 is continuous to a fitting groove 19, which extends in the circumferential direction of the pole base member 5. The fitting groove 19 is formed along the entire outer peripheral surface of the pole base member 5 at a portion near the upper end 5*b* thereof. The fitting groove 19 has upper and lower edges 19*a* and 19*b* to which projections 21 and 23 are formed so as to project inwardly of the fitting groove 19.

In a preferred embodiment, though not shown, another groove substantially the same structure of the groove 11 is formed to the pole base member 5 on the side opposing to the groove 11 in approximately axially symmetrical manner.

Figure 5:
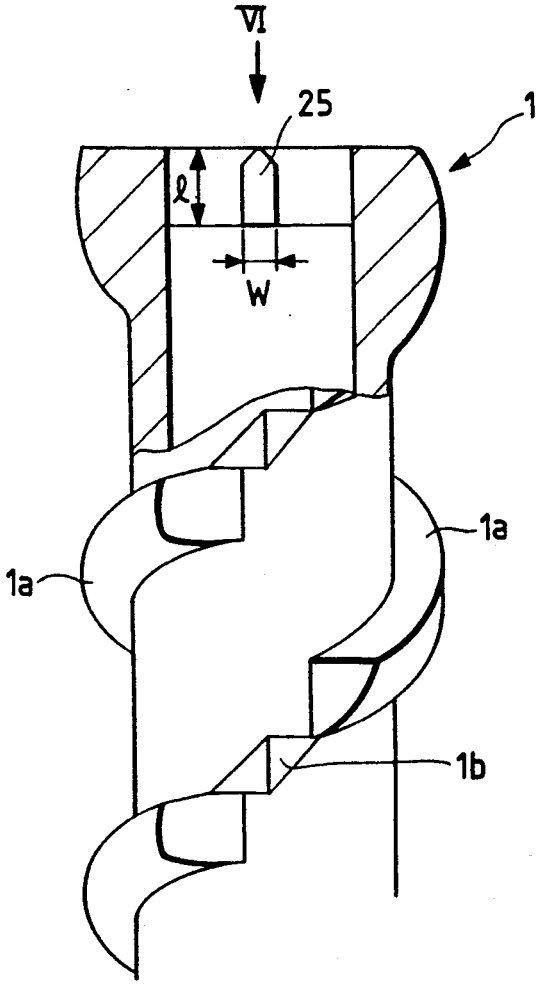
FIG. 5 is a front view of a top portion of a cylindrical member of the pole device of FIG. 1.
Figure 6:
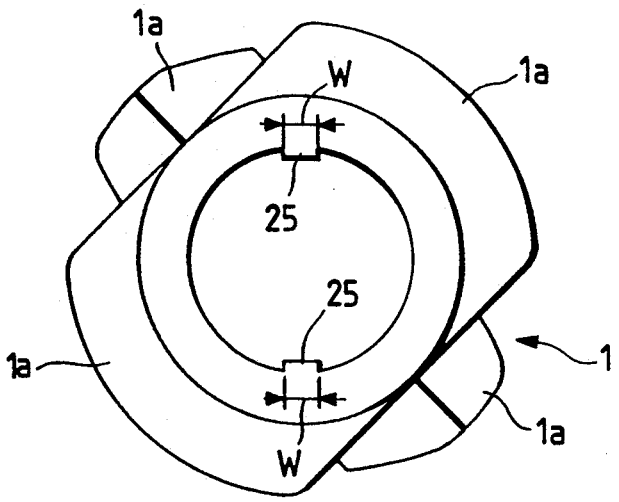
FIG. 6 is a top plan view of the cylindrical member as viewed from an arrowed direction VI in FIG. 5.

Next, referring to FIGS. 5 and 6, a pair of projections 25, 25 are formed to the inner peripheral surface of the cylindrical member 1, at upper end portion thereof, in an axially symmetrical arrangement so as to be engaged with the grooves 11 of the pole base member 5 when fitted. The projection 25 has a width w which is slightly smaller than each of widths W of the first and second guide grooves 13 and 17. The projection 25 enters the groove 11 from the opened lower end of the first guide groove 13, when fitted, and the pole base member 5 is further deeply fitted into the inner hollow portion of the cylindrical member 1 by depressing the same downward, the projections 25 advance upward through the first guide groove 13, the second guide groove 17 and then the circumferential fitting groove 19 on the upper end side 5*b* of the pole base member 5.

The pole device according to the present invention of the structure described above is set in use in the following manner.

The cylindrical member 1 is first embedded in the snow. At this time, a certain jig, not shown, is fitted inside the cylindrical member 1 and the head of the jig is then struck by means of, for example, a hammer, or a handle means is fixed to the jig and the handle means is rotated to screw in the cylindrical member 1 into the snow.

In the next step, the pole base member 5 fitted with the pole 3 is fitted into the cylindrical member 1 embedded in the snow. In this fitting operation, the opened end of the first guide groove 13 is mated with the projection 25 and the pole base member 5 is then depressed downward. It will be desired to mark a positioning marker to the end surfaces of the pole base member 5 and the cylindrical member 1 for easy visual fitting thereof.

When the pole base member 5 with the pole 3 engaged is depressed, the projection 25 enters the groove 11 and advances in the first guide groove 13 upward along its axial direction. The projection 25 will then collide with the the tapered lower surface of the triangular projection 15 projecting inward of the first guide groove 13. Upon this collision, the guide piece 15 is forced by the projection 25 and rotated in the circumferential direction according to the tapered surface thereof, and the projection 25 goes over the guide piece 15 and further advances in the second guide groove 17 from the first guide groove 13. The projection 25 then advances between projections 21 and 23 formed to the circumferential fitting groove 19, and rotates the pole base member 5 in the circumferential direction. The projection 25, after the disengagement from the projections 21 and 23, is moved into the fitting groove 19 and finally firmly fitted therein.

In this embodiment, as shown in FIG. 5, the projection 25 is formed so as to have an axial length 1 which is smaller than each of the axial lengths $1_1$ and $1_2$ formed on both axial sides of the guide piece 15 on the circumferentially shifted groove portion 13*a* of the first guide groove 13, and the length 1 of the projection 25 is also slightly smaller than a distance $1_3$ between the projections 21 and 23 of the fitting groove 19.

According to the structures and characters of the pole device described above, the pole base member 5 with the pole 3 being fitted can be easily fitted manually into the cylindrical member 1 by abutting the opened end of the first guide groove 13 against the projection 25 and then depressing the pole base member 5.

After the fitting of the pole base member 5 into the cylindrical member 1, when it is required to draw out the pole base member 5 manually by hands, the pole base member 5 is first lifted upward by the length corresponding to the height h of the projection 21 and then circumferentially rotated to move the pole base member 5 to a position between the projections 21 and 23. Thereafter, the projection 25 is positioned just above the second guide groove 17 and the pole base member 5 is further lifted upward, whereby the projection 25 enters the second guide groove 17 and then advances therein.

Upon abutting against the guide piece 15, the pole base member 5 is rotated in one circumferential direction, and when the projection 25 goes over the guide piece 15, the pole base member 5 is then rotated in the opposing, i.e. reverse, circumferential direction. Accordingly, the projection 25 moves into the first guide groove 13. In this state, the projection is disengaged from the groove 11 by lifting upward the pole base member 5, and the pole base member is thus drawn out manually from the cylindrical member 1.

Namely, in order to draw out the pole base member 5 from the cylindrical member 1, many manual operations such as lifting the pole base member 5 and rotating the same in one and opposite circumferential directions are required. Accordingly, it is substantially impossible that these operations are accidentally carried out even by repeated collision of the skiing contestants or players with the pole 3 during the skiing contest, so that the pole base member 5 cannot be drawn out unintentionally from the cylindrical member 1 by the pole device according to the described embodiment of the present invention.

As described hereinbefore, according to the pole device for the skiing contest of the present invention, the pole base member cannot substantially be drawn out unintentionally from the cylindrical member embedded in the snow, but it can be easily drawn out intentionally therefrom, thus such conflicting functions being easily attained, which are not substantially impossible in the prior art pole device.

It is to be noted that the present invention is not limited to the described embodiment and many other changes and modifications may be made without departing the scope of the appended claims.

What is claimed is:

1. A pole device for a skiing contest, comprising:

a cylindrical member to be embedded in a snow ground, said cylindrical member having inner hollow portion;

a pole base member to be fitted into the inner hollow portion of the cylindrical member; and standing upward on the snow ground when the pole base member is fitted to the cylindrical member embedded in the snow ground, wherein said pole base member is formed with a groove means extending in an axial direction thereof on an outer peripheral surface thereof and said cylindrical member is formed with a projection means at an inner peripheral surface of an open end of the inner hollow portion, said projection means having an outer shape to be fitted in said groove means of the pole base member at one end thereof, said groove means being composed of a first guide groove having an end portion through which said projection means enters the groove means, a second guide groove formed to be continuous to the first guide groove and a circumferential groove formed at a portion near another end of the pole base member to be continuous to the second guide groove, said first guide groove being provided with a circumferentially shifted groove portion of the pole base member and said second guide groove being continuous to the circumferentially shifted groove portion.

2. A pole device according to claim 1, wherein a pair of said groove means are formed on the outer peripheral surface of the pole base member in a symmetrical arrangement with respect to an axis thereof and a pair of said projection means are formed on the inner peripheral surface of the cylindrical member in a symmetrical arrangement with respect to an axis thereof, said projection means being positioned at portions corresponding to the arrangement of the groove means when fitted.

3. A pole device according to claim 2, wherein a triangular guide piece is formed to an edge portion of the circumferentially shifted groove portion so as to project inward thereof.

4. A pole device according to claim 3, wherein said triangular guide piece has an upward tapered surface on a side facing one end of the pole base member.

5. A pole device according to claim 3, wherein each of said projection means has a width smaller than each of widths of said first and second guide grooves and has an axial length smaller than each of axial lengths of the circumferentially shifted groove portion on both axial sides of the guide piece.

6. A pole device according to claim 2, wherein said circumferential groove is provided with projections extending inward thereof from upper and lower edge portions, said projections having a distance therebetween slightly larger than an axial length of said projection means, said pole base member being positioned between said projections when the pole base member is finally fitted in the cylindrical member embedded in the snow ground.

7. A pole device according to claim 2, wherein said pole base member is composed of a frustoconical end portion to be first fitted into the cylindrical member and a cylindrical portion continuous to the frustoconical end portion, in which said circumferentially shifted groove portion is formed to the cylindrical portion.

8. A pole device according to claim 1, wherein said cylindrical member is formed with a spiral projection on an outer peripheral surface of the cylindrical member.

9. A pole device according to claim 8, wherein said spiral projection has cutout portions at which projection pieces are formed.

* * * * *